United States Patent [19]

Eyerly

[11] Patent Number: 4,811,530

[45] Date of Patent: Mar. 14, 1989

[54] PORTABLE PLATFORM

[75] Inventor: Jon V. Eyerly, Salem, Oreg.

[73] Assignee: J V Industries, Inc., Salem, Oreg.

[21] Appl. No.: 8,839

[22] Filed: Jan. 30, 1987

[51] Int. Cl.[4] ..... E04C 2/38

[52] U.S. Cl. ..... 52/6; 52/79.1; 52/79.5; 52/263; 52/656; 182/222; 405/218

[58] Field of Search ..... 52/6, 263, 126.6, 126.4, 52/184, 637, 638, 79.6, 656, 79.1, 79.5; 182/222–224; 405/218

[56] References Cited

U.S. PATENT DOCUMENTS

| | | | |
|---|---|---|---|
| 3,023,834 | 3/1962 | Buchanan | 182/223 |
| 3,324,614 | 6/1967 | Loewenau | 52/263 X |
| 3,472,539 | 10/1969 | Fenwick | 182/224 X |
| 3,875,707 | 4/1975 | Horn | 52/263 X |
| 4,050,257 | 9/1977 | Parks et al. | 182/222 X |
| 4,340,130 | 7/1982 | Payne et al. | 182/222 X |
| 4,461,132 | 7/1984 | Schmidt et al. | 52/656 |
| 4,620,612 | 11/1986 | Enoki et al. | 182/223 X |

*Primary Examiner*—David A. Scherbel
*Assistant Examiner*—Richard E. Chilcot, Jr.
*Attorney, Agent, or Firm*—Olson and Olson

[57] ABSTRACT

A portable platform is formed of a plurality of elongated floor support members interconnected longitudinally and spaced apart laterally, the support members having a plurality of longitudinally spaced cross members, the confronting cross members being secured in alignment by interengaging coupling members and the laterally spaced floor support members being secured against lateral displacement by a plurality of elongated locking members interengaging adjacent pairs of support members. A plurality of elongated floor members are supported on the foregoing assembly and are secured together releasably along their longitudinal edges. The perimeter of the assembly of floor members is secured against vertical displacement relative to the underlying support assembly by means of a plurality of perimeter floor hold-down members which are secured removably against vertical and longitudinal displacement by a plurality of perimeter floor hold-down support members removably connected to the outer ends of the support members and outwardly extending associated cross members.

11 Claims, 2 Drawing Sheets

PORTABLE PLATFORM

BACKGROUND OF THE INVENTION

This invention relates to floors, and more particularly to a platform capable of being transported in disassembled condition and erected on a selected site with speed and facility.

Portable platforms provided heretofore are characterized by complex and costly construction of a large number of different components requiring substantial time and personnel for assembly and disassembly.

SUMMARY OF THE INVENTION

This invention provides a portable platform from a plurality of each of but a few components.

The principle objective of this invention is to provide a portable platform of the class described in which a minimum number of different components results in minimum cost of manufacture and time of assembly and disassembly.

Another object of this invention is the provision of a portable platform of the class described in which a minimum number of different components facilitates transport from one site of assembly to another.

A further objective of this invention is the provision of a portable platform of the class described in which a minimum number of different components produces a simplified but strong and stable structure.

A still further objective of this invention is to provide a portable platform of the class described which may be adapted to a wide variety of uses.

Another object of this invention is the provision of a portable platform of the class described which may incorporate a perimeter wall and a protective fence.

These and other objects and advantages of this invention will appear from the following detailed description, taken in connection with the accompanying drawings of a preferred embodiment.

DESCRIPTION OF THE PREFERRED EMBODIMENT

Figures 1, 2:
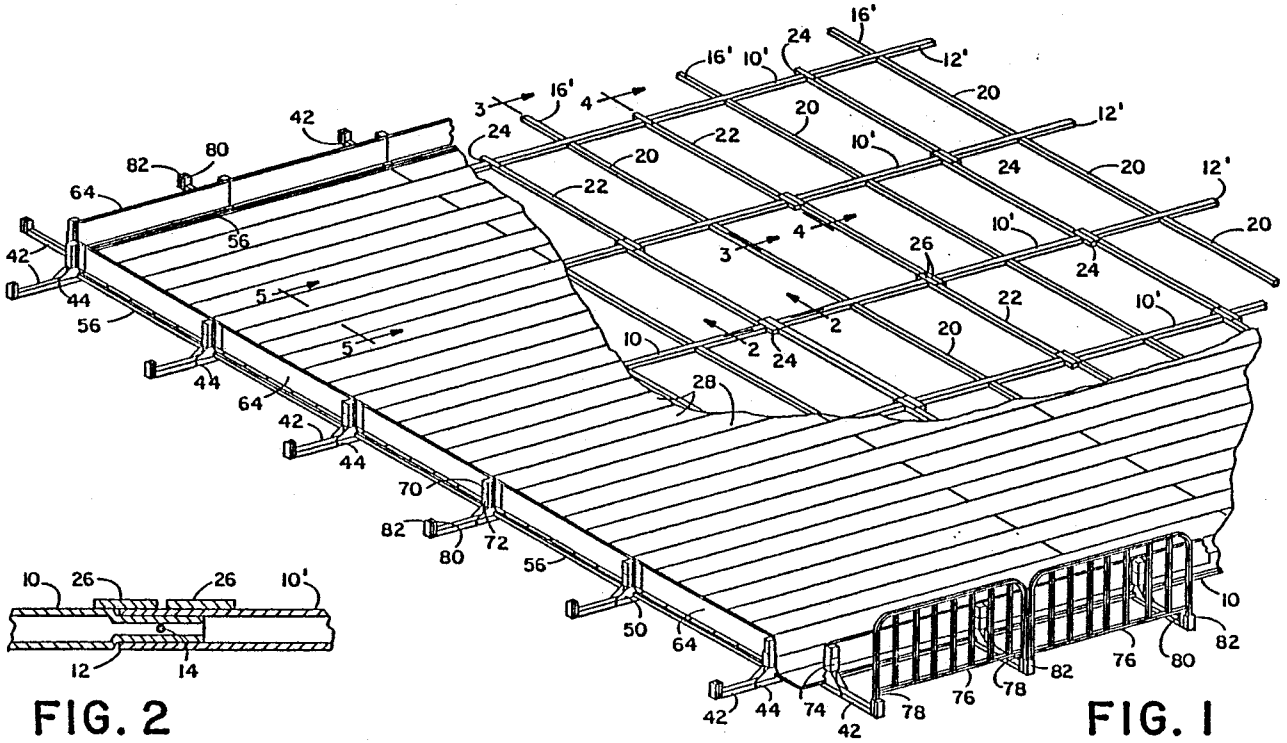
FIG. 1 is a fragmentary perspective view of a portable platform embodying the features of this invention.
FIG. 2 is a fragmentary sectional view taken on the line 2—2 in FIG. 1.

Referring primarily to FIGS. 1 and 2 of the drawings, the portable platform assembly illustrated includes a plurality of elongated primary floor support members 10 and a plurality of elongated secondary floor support members 10'. Each primary support member 10 is provided at each of its ends with a male section 12 of reduced cross sectional dimensions as compared with the intermediate length of the member. Each secondary support member 10' is provided with one male end section 12' of the same reduced cross sectional dimensions as the end sections of the primary support members and with the opposite, female end section of the same larger cross sectional dimensions as the intermediate length of the member for telescopic connection with the adjacent reduced male end section of a primary floor support member, for extending the longitudinal dimension of the floor. These telescoped ends preferably are secured together releasably by a transverse pin 14 extended through aligned holes in the telescoped parts.

Each of the floor support members also is provided with a plurality of longitudinally spaced, laterally extending cross arms. In the illustrated embodiment, the inwardly extending cross arms on the perimeter primary and secondary floor support members are identified by reference numeral 16 (FIG. 3), and the companion, outwardly extending cross arms are identified by the reference number 16' (FIG. 1). These outwardly extending cross arms 16' may be shorter or longer than the inwardly extending cross arms 16, depending upon their intended use. The laterally extending cross arms on the interior primary and secondary floor support members are identified by the reference numeral 18. All of these cross arms have the same cross sectional dimensions as the reduced end sections 12 and 12' of the primary and secondary floor support members, for the telescopic reception of floor confining members described hereinafter.

Figure 3:
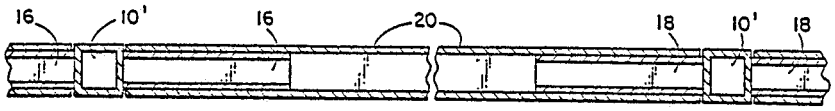
FIG. 3 is a fragmentary foreshortened sectional view taken on the line 3—3 in FIG. 1 to show the construction and mode of operation of the coupler component of the assembly.

With the floor support members 10 and 10' arranged in the longitudinally joined and laterally spaced configuration illustrated in FIG. 1, the confronting cross arms 16 and 18 are joined together by the coupling members 20. As illustrated in FIG. 3, the coupling members are in the form of elongated square tubings dimensioned to telescope over the confronting cross arms 16 and 18, to maintain the assembly of floor support members in squared condition.

Figure 4:
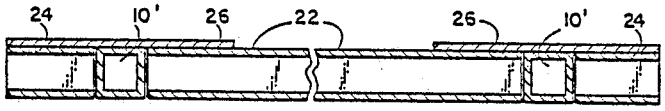
FIG. 4 is a fragmentary foreshortened sectional view taken on the line 4—4 in FIG. 1 to show the structure and mode of operation of the locking component of the assembly.

The floor support members thus joined together by the coupling members 20 are secured against lateral separation by a plurality of locking members which are interposed between pairs of coupling members. As best illustrated in FIG. 4, each locking member includes an elongated central square tubing 22 and a pair of similarly configured square end tubes 24. These end tubes are spaced longitudinally outward of the central tube and secured in that spaced apart relationship by means of a connecting strap 26 as by welding or any other conventional method. The spaces provided between the central tube and the end tubes are configured to receive removably therein laterally adjacent floor support members. The floor support members thus are secured against lateral displacement.

Figure 5:
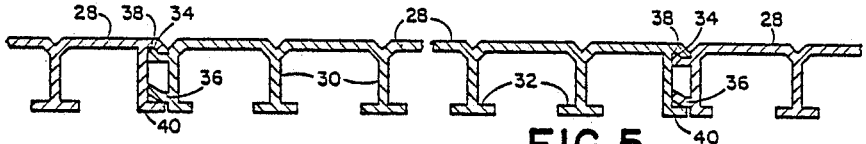
FIG. 5 is a fragmentary foreshortened sectional view taken on the line 5—5 in FIG. 1 to show the structure and interlocking arrangement of the floor components of the assembly.

The assembly of floor support members, coupling members 20 and locking members 22, 24, 26 function as a base support for a plurality of floor members. As best illustrated in FIG. 5, each floor member preferably is formed as a one-piece extrusion, preferably of aluminum. In cross-section the floor member includes a plurality of horizontal top segments 28, a plurality of vertical support segments 30 extending downward from the horizontal top segments and terminating at their bottom ends in horizontal base segments 32.

One longitudinal edge of the floor segment is configured to provide a male connector tab 34 and a male connector base 36. The opposite longitudinal side edge of the floor member is configured to provide a female connector notch 38 and a female connector base 40. The male connector tab is arranged to interlock removably with the female connector notch by initially orienting one floor member angularly upward relative to an adjacent floor member to allow the male connector tab to enter the female connector notch, after which the angularly disposed floor member is rotated downardly into the plane of the adjacent floor member. The male connector base 36 then rests upon the female connector base for support.

As illustrated in FIG. 1, the floor members are provided in two different lengths so that the longitudinal ends of abutting floor members do not all lie on a common line. For example, in the embodiment illustrated, one group of floor members may be 13 feet long and a second group of floor members may be 19 feet long, whereby to provide a portable platform having a length of 32 feet. It will be understood, of course, that a variety of different lengths of floor members may be provided for the construction of platforms of any desired dimensions.

With the floor members assembled and interconnected, the assembly is confined against horizontal movement relative to the underlying floor support assembly by means of perimeter abutment members. Additionally, the perimeter of the floor assembly preferably is secured to the underlying support assembly against vertical displacement by means of hold-down members.

Thus a plurality of floor confining members each includes a length of hollow tubing 42 configured to be received telescopically over the outer ends 12 and 12' of the outer margin support members 10 and 10' and outwardly extending associated cross arms 16. A locking pin 44 (FIG. 1) extends removably through registering openings 46 in the hollow tube 42 and associated telescoped member for preventing displacement of the hollow tube 42. A cotter pin or shap ring 48 is used to prevent accidental retraction of the pin 44.

The hollow tube 42 mounts a pair of laterally spaced flanges 50 the forward ends of which are undercut to provide a pair of vertical abutment edges 52 disposed for abutment by the perimeter edges of the floor members 28 to confine the floor against horizontal displacement relative to the underlying floor support assembly. The flanges 50 also include a pair of hooks 54 extending inward from the upper ends of the edges 52 and spaced upwardly from the tube 42 a distance sufficient to removably receive under the hooks the perimeter portion of the floor members 28 to prevent upward displacement of the floor members relative to the underlying floor support assembly.

Figure 7:
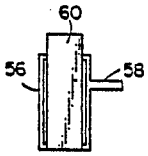
FIG. 7 is an end elevation of the floor hold-down angle member as viewed from the left in FIG. 6.
Figure 6:
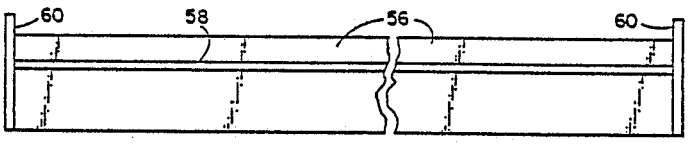
FIG. 6 is a fragmentary foreshortened front elevation of the floor hold-down angle member.
Figure 9:
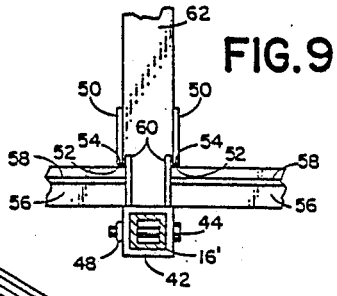
FIG. 9 is a fragmentary sectional view showing the manner of installation of the floor hold-down angle members.
Figure 8:
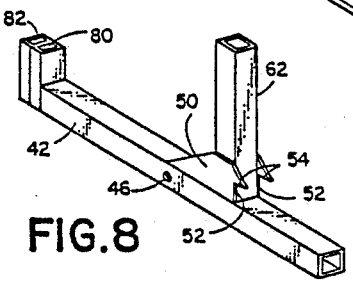
FIG. 8 is a fragmentary perspective view of the floor hold-down assembly.

In the preferred embodiment illustrated, the floor hold-down hooks 54 are assisted by floor hold-down members which engage the entire perimeter area of the floor members 28. As best illustrated in FIGS. 6 and 7, each hold-down member includes an elongated tubing 56 of rectangular cross-section configured for removable reception against the vertical edges 52 under the hooks 54. Welded or otherwise secured to the forward side of the tubing is a flange 58 which extends the length of the tubing 56 and projects perpendicularly forward therefrom. The flanged tubing thus forms an angle iron configuration. A retainer tab 60 is secured to each of the opposite ends of the tubing and projects upwardly therefrom, for abutting the inner sides of the hooks 54 (FIG. 9) which thus prevent longitudinal displacement of the hold-down members.

The forwardly projecting flange 58 on each hold-down tubing 56 overlies the perimeter of the floor members 28 and thus prevents the floor members from being displaced vertically upward away from the underlying floor support assembly of members 10, 10', 20 and 22.

Although each hold-down member illustrated extends between adjacent tubings 42 it will be understood that it may be long enough to extend between three or more such tubings 42. In fact, each tubing may extend the full length of one side of a floor.

Each hollow tube 42 also preferably mounts a vertically extending wall support post 62 which preferrably is located between the pair of flanges 50. These posts serve to mount the opposite ends of a plurality of vertically extending wall members 64 which define the perimeter of the floor and may serve any of a variety of specific functions. Each wall member 64 preferably is formed of a length of the same extrusion which provides the floor members.

Figure 10:
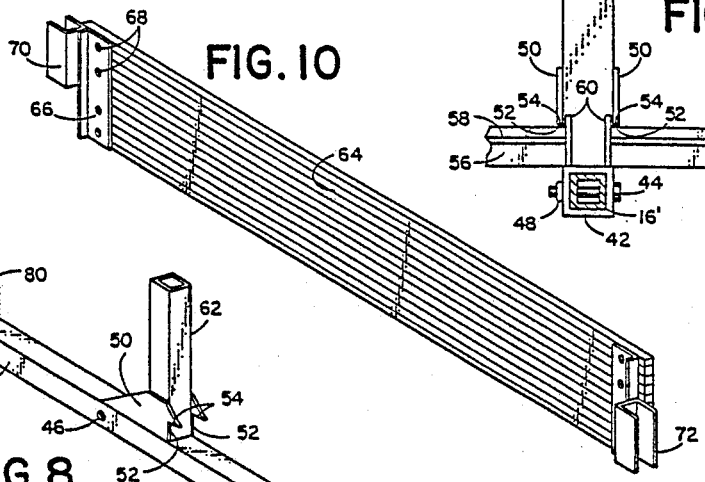
FIG. 10 is a perspective view of the perimeter wall component of the assembly.

An end angle bracket 66 (FIG. 10) is secured to each of the opposite ends of the wall member 64, as by means of screws 68. To one of these end angle brackets is secured an upper U-shaped mounting guide 70 and to the other end angle bracket is secured a lower mounting guide 72. These mounting guides are configured to removably engage the vertical wall support posts 62 which thus support the wall members therebetween.

As best illustrated in FIG. 1, the arrangement of outwardly opening U-shaped upper and lower mounting guides at the opposite ends of each wall member 64 facilitates the assembly of wall members about the perimeter of the platform. The open side of the guides 70 and 72 allows the latter to engage posts 62 which may be tilted angularly from vertical by virtue of the platform being supported upon uneven ground. The upper mounting guide 70 overlies the lower mounting guide 72 of the adjacent wall member. Where a wall member terminates on a post 62 which does not support an adjacent wall member, a spacer tube 74 may be installed on the post under the upper mounting guide 70 of the terminating wall member 64.

The portable platform of this invention also may include a security fence spaced outwardly from the floor. In the embodiment illustrated, a plurality of fence segments 76 each is provided at its opposite ends with a pair of downwardly extending legs 78 configured for removable reception in the inner anchor sockets 80 or outer anchor sockets 82 mounted at the outer end of each floor-confining tube 42. The legs of adjacent fence segments are received one in the inner anchor socket 80 and the other in the outer anchor socket 82, as illustrated in FIG. 1. This inner and outer lapping arrangement of adjacent fence segment facilitates the formation of a positive security enclosure.

In FIG. 1 the lower corner of the platform is shown to be open slightly because the wall segments do not join together at the corner. This opening also may be closed by a fence segment 76 arranged to extend between the anchor sockets mounted on the support tubes 42 which project outwardly at right angles to each other at the corner of the platform. For this purpose the legs of the fence segment may be round in cross section to fit within the rectangular anchor socket 80 or 82.

If desired, the fence segments may be supported by the posts 62 by inserting the legs 78 into the open upper ends of the posts.

The structural configuration of the various components described hereinbefore facilitates assembly and disassembly of the portable platform in a minimum of time and with a minimum of personnel. For example, a portable platform having a length of 32 feet and a width of 26 feet may be assembled by two unskilled workmen in less than 1.5 hours, and may be disassembled in the same time. This includes the assembly of the vertical wall members 64 and fence segments 76. If the wall and fence are omitted, the floor can be assembled or disassembled in less than one hour.

It is to be noted that the portable platform is comprised of a minimum number of similar components. Thus, the basic portable platform is made of a plurality of but five components. One additional component may provide the perimeter wall 64 and a second additional component may provide the full perimeter floor hold-down members 56–60. A third component may provide the fence segments 78. The spacer tubes 74 are not critical.

The minimum number of different components required for the portable platform also contributes to the facility with which the components may be collected together for transport from one site to another. Further, the provision of a plurality of each of the small number of different components also contributes significantly to minimizing the cost of manufacture.

The portable platform of this invention may be utilized for a wide variety of purposes. For example, it may form the floor for an amusement ride, such as a plurality of bumper cars. For such purpose the vertical wall members 64 serve as a bumper rail to confine the cars to the floor area, and the fence section 78 secure the perimeter of the platform to prevent access to the platform except through a designated doorway.

It will be apparent to those skilled in the art that various changes may be made in the size, shape, type, number and arrangement of parts described hereinbefore, without departing from the spirit of this invention and the scope of the appended claims.

Having now described my invention and the manner in which it may be used, I claim:

1. A portable platform, comprising:

(a) a plurality of elongated floor support members spaced apart laterally to form outer margin and intermediate floor supports, (b) each floor support member having a plurality of longitudinally spaced pairs of axially aligned cross members extending laterally in opposite directions, the confronting pairs of cross members of adjacent support members being in axial alignment, (c) a plurality of elongated coupling members each removably connected at its opposite ends to a confronting pair of cross members, (d) a plurality of elongated locking members each removably interengaging an adjacent pair of support members in between adjacent coupling members for securing said support members against lateral displacement, (e) a plurality of elongated floor members overlying the assembly of support members, cross members, coupling members and locking members and releasably secured together at their longitudinal edges, and (f) a plurality of perimeter floor confining members removably connected to the outer ends of the floor support members and outwardly extending perimeter cross members for confining the floor members against horizontal displacement relative to the underlying floor support assembly.

2. The portable platform of claim 1 wherein the floor confining members include floor hold-down members overlying the perimeter of the floor members to prevent upward displacement of the floor members relative to the underlying floor support assembly, the floor hold-down members comprising hook members supported by and overlying the perimeter of the floor members, and a plurality of elongated angle iron members extending along the perimeter of the floor members and each having an outwardly and upwardly projecting tab on each end, at least some of the hook members removably receiving one end of an angle iron member with the associated tab confined removably by one of the hooks.

3. The portable platform of claim 2 wherein each perimeter floor confining member comprises a hollow tube on said outer ends of the floor support members and outwardly extending perimeter cross members and mounting a pair of spaced hooks configured to removably between the pair of hooks.

4. The portable platform of claim 1 wherein each coupling member is a hollow tube freely receiving in its opposite ends a confronting pair of cross members.

5. The portable platform of claim 1 wherein each locking member has a pair of longitudinally spaced notches configured to removably receive therein an adjacent pair of support members for securing said support members against lateral displacement.

6. The portable platform of claim 1 wherein each locking member comprises a central elongated hollow tube section and a pair of hollow tube end sections spaced outwardly of the central section and secured thereto by an interconnecting strap, the strap and space between the tube sections defining a notch removably receiving a support member therein.

7. The portable platform of claim 1 including an upwardly extending wall supporting post on each floor confining member, and a plurality of elongated wall members each mounted removably at its opposite ends on an adjacent pair of wall supporting posts.

8. The portable platform of claim 7 wherein each wall member has a guide member at each end configured to removably engage an adjacent pair of said wall supporting posts.

9. The portable platform of claim 1 including a fence support member on each floor confining member, and a plurality of fence members each mounted removably at its opposite ends on an adjacent pair of fence support members.

10. In a portable platform having a plurality of elongated floor support members spaced apart laterally to form outer margin and intermediate floor supports, a plurality of elongated locking members spaced apart longitudinally of and spanning adjacent floor support members for securing said floor support members against lateral displacement, each locking member having a pair of longitudinally spaced notches configured to removably receive therein an adjacent pair of said floor support members for securing said floor support members against lateral displacement.

11. The portable platform of claim 10 wherein each locking member comprises a central elongated hollow tube section and a pair of hollow tube end sections spaced outwardly from the central section and secured thereto by an interconnecting strap, the strap and space between the tube sections defining a notch removably receiving a support member therein.

* * * * *

UNITED STATES PATENT AND TRADEMARK OFFICE

CERTIFICATE OF CORRECTION

PATENT NO. : 4,811,530

DATED : 14 March 1989

INVENTOR(S) : Jon V. Eyerly

It is certified that error appears in the above-identified patent and that said Letters Patent is hereby corrected as shown below:

Column 6, line 33, before "between" insert -- receive one end of each of a pair of angle iron members with the associated tabs confined removably --.

Signed and Sealed this

Twenty-fourth Day of October, 1989

*Attest:*

DONALD J. QUIGG

*Attesting Officer*

*Commissioner of Patents and Trademarks*